US012668905B2

(12) United States Patent
Wayment et al.

(10) Patent No.: US 12,668,905 B2
(45) Date of Patent: Jun. 30, 2026

(54) SEWING MACHINE VIBRATION DAMPENER

(71) Applicant: Gracewood Management, Inc., West Jordan, UT (US)

(72) Inventors: Cody Wayment, West Jordan, UT (US); Michael Campbell, West Jordan, UT (US)

(73) Assignee: GRACEWOOD MANAGEMENT, INC., West Jordan, UT (US)

( * ) Notice: Subject to any disclaimer, the term of this patent is extended or adjusted under 35 U.S.C. 154(b) by 0 days.

(21) Appl. No.: 18/969,938

(22) Filed: Dec. 5, 2024

(65) Prior Publication Data

US 2025/0188659 A1 Jun. 12, 2025

Related U.S. Application Data

(60) Provisional application No. 63/607,216, filed on Dec. 7, 2023.

(51) Int. Cl.
*D05B 69/32* (2006.01)
*D05B 55/14* (2006.01)

(52) U.S. Cl.
CPC ..... *D05B 69/32* (2013.01); *D05B 55/14* (2013.01)

(58) Field of Classification Search
CPC ..... D05B 69/32
See application file for complete search history.

(56) References Cited

U.S. PATENT DOCUMENTS

| | | | | |
|---|---|---|---|---|
| 3,525,373 | A | 8/1970 | Kobayashi | |
| 4,061,096 | A * | 12/1977 | Elsas | D05B 11/00 112/155 |
| 4,669,403 | A * | 6/1987 | Bagnall | D05C 15/20 112/80.4 |
| 5,287,819 | A * | 2/1994 | Beatty | D05C 15/20 112/80.4 |
| 9,809,912 | B2 | 11/2017 | McKinney et al. | |
| 2008/0245181 | A1 * | 10/2008 | Morgante | D05B 69/32 74/604 |
| 2009/0126610 | A1 * | 5/2009 | Suzuki | D05B 19/14 112/155 |

* cited by examiner

*Primary Examiner* — Patrick J. Lynch
(74) *Attorney, Agent, or Firm* — Ryan L. Marshall; Jessica Kiser; Barnes & Thornburg LLP

(57) ABSTRACT

A sewing machine assembly includes a sewing machine frame, a needle bar, a drive shaft, and a vibration dampener system. The needle bar configured to linearly reciprocate relative to the sewing machine frame along a needle bar axis. The drive shaft is coupled to the needle bar and configured to rotate about a drive axis to drive linear reciprocation of the needle bar along the needle bar axis. The vibration dampener system is coupled to the drive shaft to reduce vibration of the sewing machine assembly caused by linear reciprocation of the needle bar during use of the sewing machine assembly.

17 Claims, 7 Drawing Sheets

SEWING MACHINE VIBRATION DAMPENER

CROSS REFERENCE TO RELATED APPLICATION

This application claims priority to and the benefit of U.S. Provisional Patent Application No. 63/607,216, filed 7 Dec. 2023, the disclosure of which is now expressly incorporated herein by reference.

FIELD OF DISCLOSURE

The present disclosure relates generally to sewing or quilting machines, and more specifically to attachments for sewing or quilting machines.

BACKGROUND

Sewing machines are used for stitching one or more pieces of fabric with thread. Some sewing machines are stationary such that fabric is fed under a needle of the sewing machine, while other sewing machines, like quilting machines, are maneuverable such that the needle may be moved across the fabric.

Maneuverable sewing machines allow a user to create intricate patterns with the stitching. Such sewing or quilting machines, however, may also make it difficult to accurately follow a path on the fabric, such as a seam, a ditch line, or another desired pattern. They are also subject to vibrational feedback making it more difficult for the user to precise control movement of the machine.

SUMMARY

The present disclosure may comprise one or more of the following features and combinations thereof.

A sewing machine assembly may comprise a sewing machine frame, a needle bar, a drive shaft coupled to the needle bar axis, and a vibration dampener system. The sewing machine frame may include a frame base, a frame body that extends from the frame base, a frame head coupled to the frame body that extends from the frame body toward the frame base to define a throat of the sewing machine frame. The needle bar may be configured to linearly reciprocate relative to the sewing machine frame along a needle bar axis. The drive shaft may be configured to rotate about a drive axis in a first direction to drive linear reciprocation of the needle bar along the needle bar axis. The vibration dampener system may be coupled to the drive shaft to reduce vibration of the sewing machine assembly caused by linear reciprocation of the needle bar during use of the sewing machine assembly.

In some embodiments, the vibration dampener system may comprise a first counterbalance shaft configured to rotate about a first axis in the first direction, a first offset weight coupled to the first counterbalance shaft for rotation therewith, a second counterbalance shaft configured to rotate about a second axis in a second direction, and a second offset weight coupled to the second counterbalance shaft for rotation therewith. The second direction rotation of the second counter balance shaft may be opposite the first direction of the first counterbalance shaft. The second offset weight may oppose the first offset weight at neutral positions as the needle bar linearly reciprocates relative to the sewing machine frame. In some embodiments, the first offset weight is equal to the second offset weight.

In some embodiments, the first counterbalance shaft may be coupled to the drive shaft so that rotation of the drive shaft about the drive axis in the first direction drives rotation of the first counterbalance shaft about the first axis in the first direction. The second counterbalance shaft may be coupled to the first counterbalance shaft so that rotation of the first counterbalance shaft about the first axis in the first direction drives rotation of the second counterbalance shaft about the second axis in the second direction opposite the first direction.

In some embodiments, the vibration dampener system may further comprise a first gear coupled to the first counterbalance shaft for rotation therewith and a second gear coupled to the second counterbalance shaft for rotation therewith. The second gear may mate with the first gear so that rotation of the first counterbalance shaft about the first axis in the first direction drives rotation of the second counterbalance shaft about the second axis in the second direction opposite the first direction.

In some embodiments, the vibration dampener system may further comprise a drive belt. The drive belt may extend between the drive shaft and the first counterbalance shaft so that rotation of the drive shaft about the drive axis in the first direction drives rotation of the first counterbalance shaft about the first axis in the first direction.

In some embodiments, the first counterbalance shaft may be coupled to the drive shaft so that rotation of the drive shaft drives rotation of the first counterbalance shaft. The second counterbalance shaft may be coupled to the drive shaft so that rotation of the drive shaft in the first direction drives rotation of the second counterbalance shaft in the second direction. In some embodiments, the first counterbalance shaft and the second counterbalance shaft may be independently driven.

In some embodiments, the sewing machine assembly may further comprise a drive linkage. The drive linkage may extend between and interconnect the drive shaft and the needle bar to transfer the rotation of the drive shaft to linear movement of the needle bar.

In some embodiments, the drive linkage may comprise a counterbalance weight coupled to one end of the drive shaft for rotation therewith with the drive shaft positioned between a higher mass end of the counterbalance weight and a lower mass end of the counterbalance weight, a link arm coupled to the lower mass end of the counterbalance weight for rotation therewith, and a needle bar crank that extends between a first end coupled to the link arm and a second end coupled to the needle bar.

In some embodiments, the sewing machine assembly may further comprise a counterbalance weight. The counterbalance weight may be coupled to one end of the drive shaft for rotation therewith with the drive shaft positioned between a higher mass end of the counterbalance weight and a lower mass end of the counterbalance weight.

According to another aspect of the present disclosure, a vibration dampener system may be adapted for use with a sewing machine to reduce vibration of the sewing machine caused by reciprocal linear movement of a needle bar during use of the sewing machine. The vibration dampener system may comprise a first counterbalance shaft, a first offset weight, a second counterbalance shaft, and a second offset weight.

In some embodiments, the first counterbalance shaft may be coupled to a drive shaft of the sewing machine and configured to rotate about a first axis in a first direction. The drive shaft may be coupled to the needle bar. The drive shaft may be configured to rotate about a drive axis in the first direction to drive linear reciprocation of the needle bar.

In some embodiments, the first offset weight may be coupled to the first counterbalance shaft for rotation therewith. The second counterbalance shaft may be coupled to the first counterbalance shaft and may be configured to rotate about a second axis in a second direction opposite the first direction of the first counterbalance shaft. The second offset weight may be coupled to the second counterbalance shaft for rotation therewith so that the second offset weight opposes the first offset weight at neutral positions as the needle bar linearly reciprocates. In some embodiments, the first offset weight is equal to the second offset weight.

In some embodiments, the vibration dampener system may further comprise a first gear coupled to the first counterbalance shaft for rotation therewith and a second gear coupled to the second counterbalance shaft for rotation therewith. The second gear may mate with the first gear so that rotation of the first counterbalance shaft about the first axis in the first direction drives rotation of the second counterbalance shaft about the second axis in the second direction opposite the first direction.

In some embodiments, the vibration dampener system may further comprise a drive belt. The drive belt may extend between the drive shaft and the first counterbalance shaft so that rotation of the drive shaft about the drive axis in the first direction drives rotation of the first counterbalance shaft about the first axis in the first direction.

These and other features of the present disclosure will become more apparent from the following description of the illustrative embodiments.

DETAILED DESCRIPTION OF THE DRAWINGS

Figure 1:
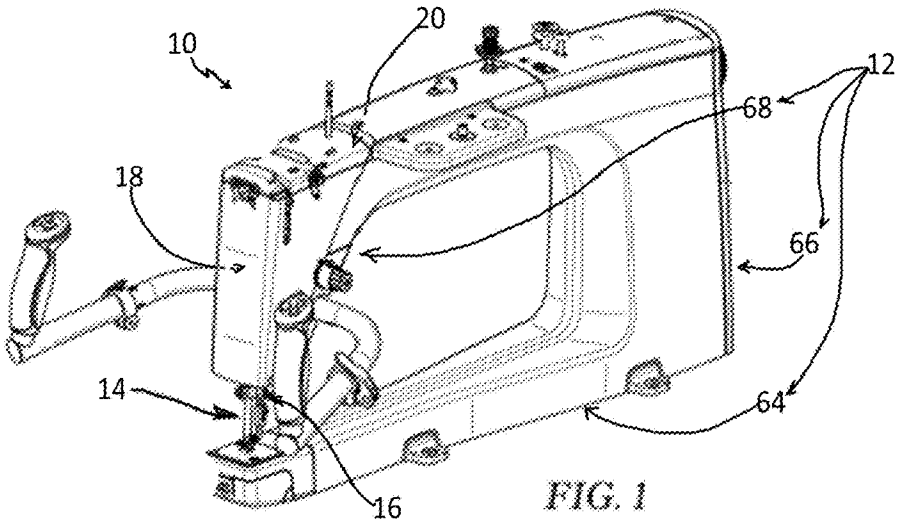
FIG. 1 is a perspective view of an illustrative sewing machine assembly showing the sewing machine assembly includes a sewing machine frame having a frame base, a frame body that extends from the frame base, a frame head coupled to the frame body that extends from the frame body toward the frame base to define a throat of the sewing machine frame.

For the purposes of promoting an understanding of the principles of the disclosure, reference will now be made to a number of illustrative embodiments illustrated in the drawings and specific language will be used to describe the same.

Figure 2:
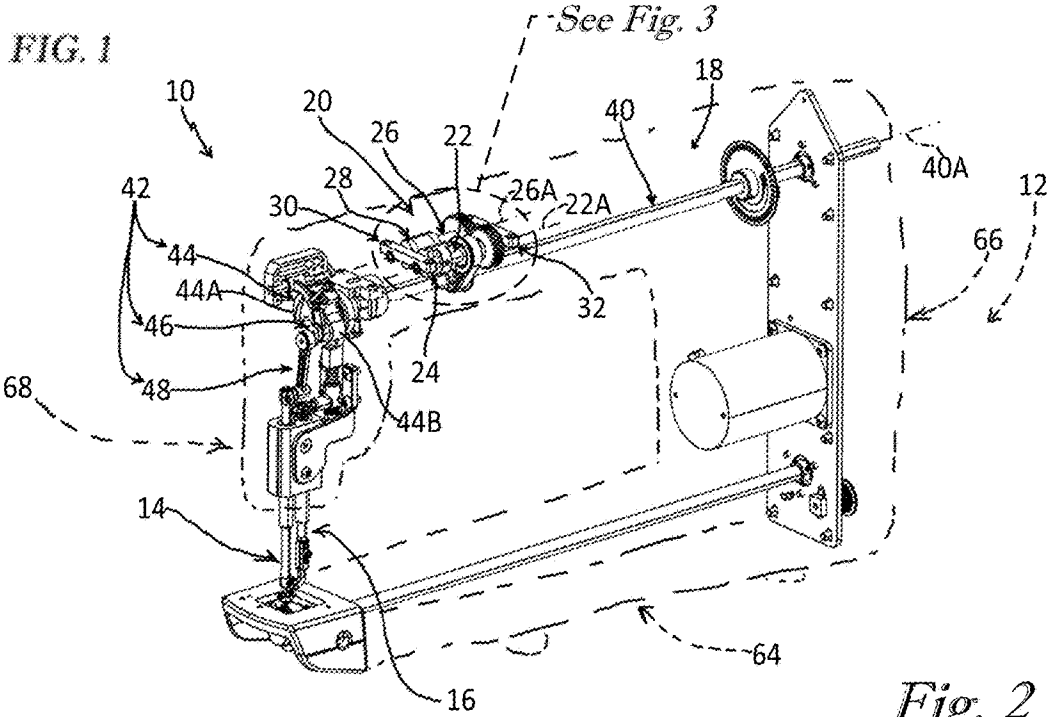
FIG. 2 is a view similar to FIG. 1 with the sewing machine frame hidden to show the sewing machine assembly further includes a needle bar configured to linearly reciprocate relative to the sewing machine frame along a needle bar axis, a drive shaft coupled to the needle bar and configured to rotate about a drive axis in a first direction to drive linear reciprocation of the needle bar along the needle bar axis, and a vibration dampener system coupled to the drive shaft to reduce vibration of the sewing machine assembly caused by linear reciprocation of the needle bar during use of the sewing machine assembly.
Figure 3:
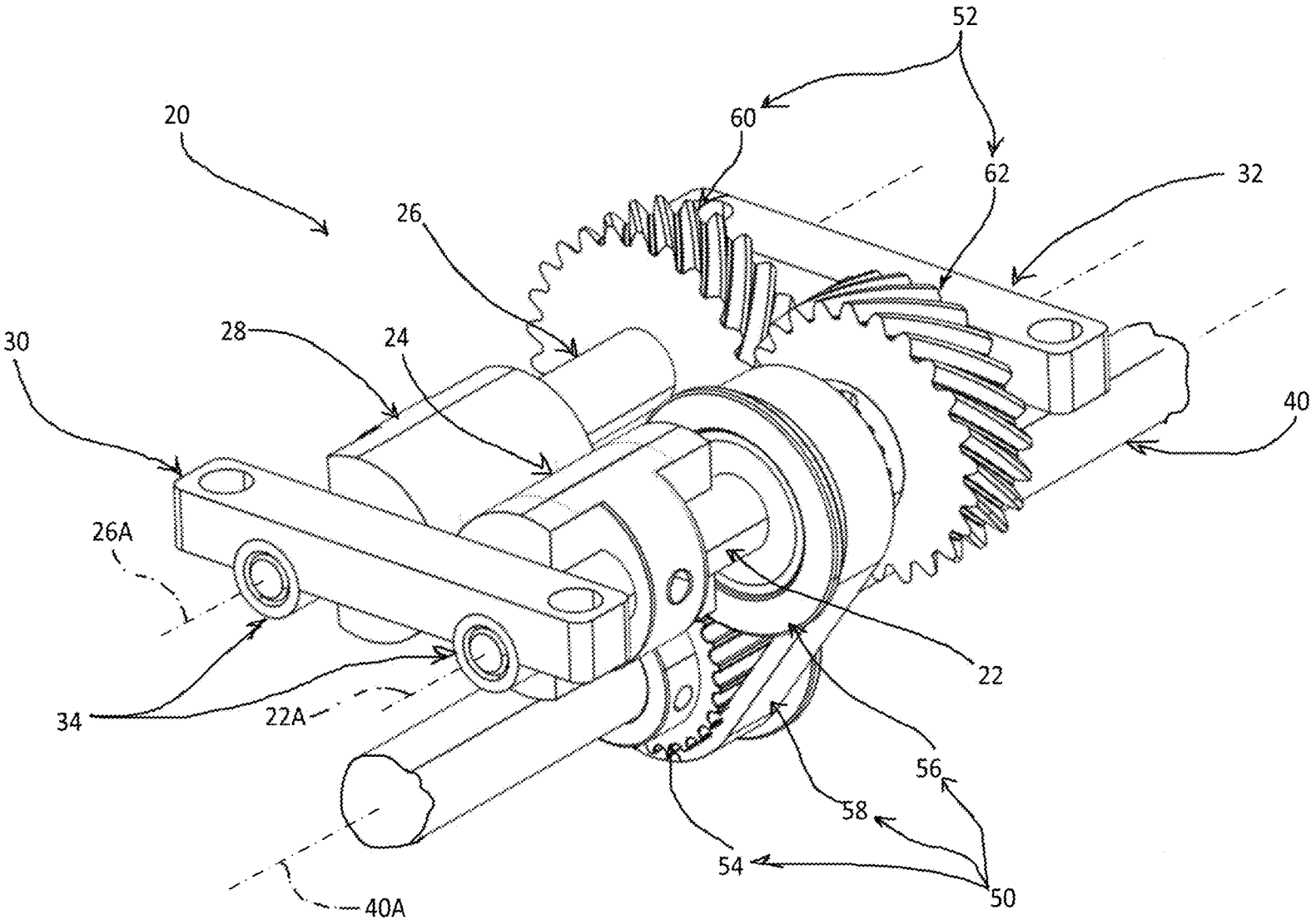
FIG. 3 is a perspective view of the vibration dampener system included in the sewing machine assembly of FIG. 2 showing the vibration dampener system includes a first counterbalance shaft with a first offset weight configured to rotate about a first axis in a first direction, a second counterbalance shaft with a second offset weight configured to rotate about a second axis in a second direction, a drive belt mechanism that couples the first counterbalance shaft to the drive shaft so that rotation of the drive shaft rotates the first counterbalance shaft about the first axis, and a gear train that mates the first counterbalance shaft and the second counterbalance shaft so that rotation of the first counterbalance shaft drives rotation of the second counterbalance shaft about the second axis.

An illustrative embodiment of a sewing machine assembly 10 is shown in FIG. 1. The sewing machine assembly 10 includes a sewing machine frame 12, a needle bar 14, a presser bar 16, a drive system 18, and a vibration dampener system 20 as shown in FIGS. 1-3. The needle bar 14 is configured to linearly reciprocate relative to the sewing machine frame 12 along a needle bar axis 14A. The presser bar 16 is mounted to the sewing machine frame 12 and supports a presser or hopping foot. The drive system 18 is configured to drive linear reciprocation of the needle bar 14 along the needle bar axis 14A. The vibration dampener system 20 configured to reduce vibration of the sewing machine assembly 10 caused by linear reciprocation of the needle bar 14 during use of the sewing machine assembly 10.

During use of a sewing machine, the drive system causes the needle bar to linearly reciprocate relative to the sewing machine frame. The oscillations of the needle bar may cause the sewing machine to vibrate. At certain speeds, the movement of the needle bar may causes the sewing machine frame to vibrate at its resonance frequency.

For freely maneuverable sewing machines, i.e. machines able to move in lateral and longitudinal directions relative to the fabric, vibration of the sewing machine frame may make it difficult for the user to accurately move the sewing machine assembly along the desired pattern or stitch line. Moreover, if the sewing machine frame begins to vibrate at its resonance frequency, the user may have a difficult time controlling the movement of the sewing machine assembly.

The sewing machine assembly 10, therefore, includes the vibration dampener system 20 to reduce vibration of the sewing machine assembly 10. The vibration dampener system 20 is coupled to the drive system 18 of the sewing machine assembly 10 to reduce vibration of the sewing machine assembly 10 in the illustrative embodiment.

Figure 4:
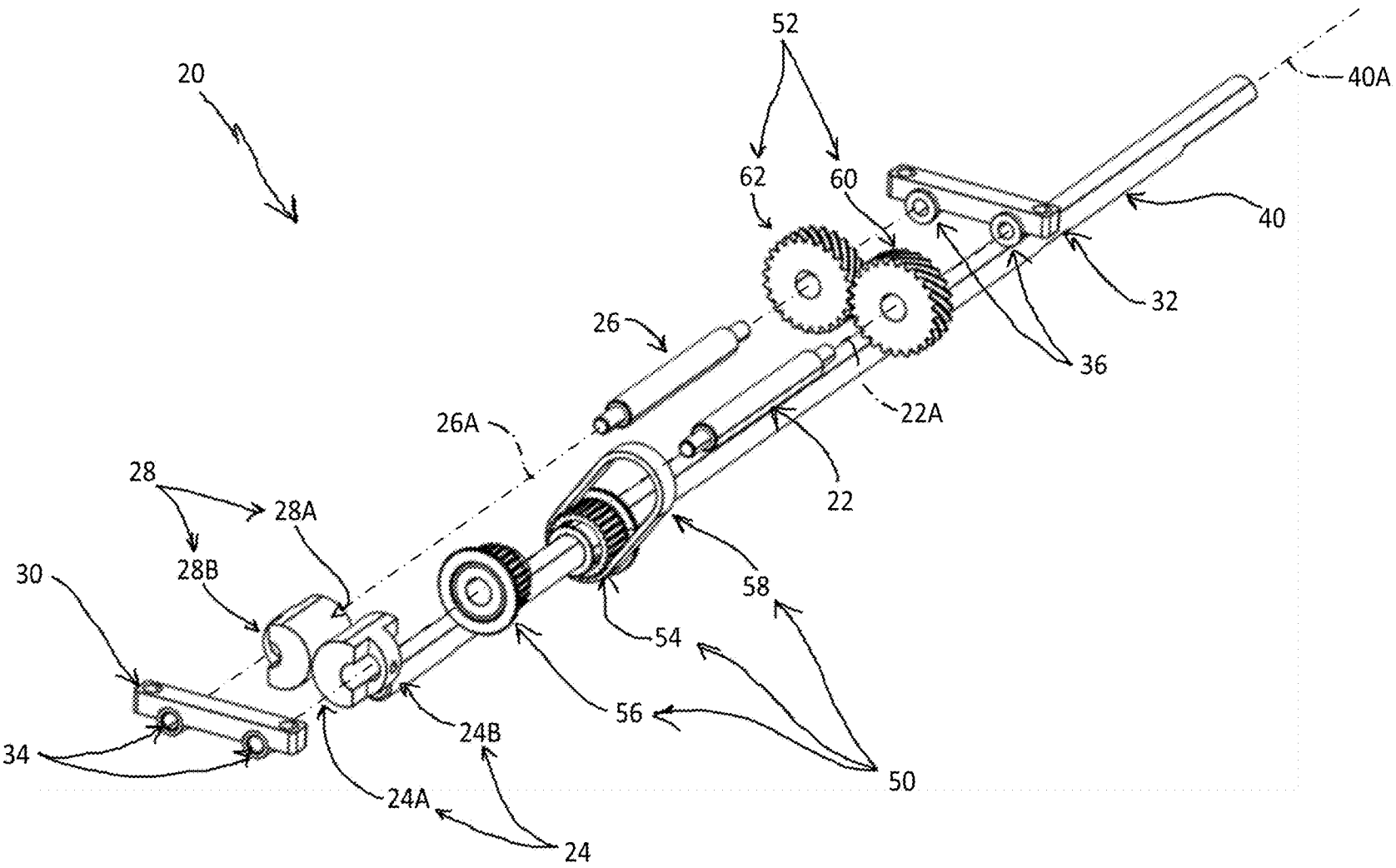
FIG. 4 is an exploded view of the vibration dampener system of FIG. 3 showing the vibration dampener system includes the first counterbalance shaft with the first offset weight, the second counterbalance shaft with the second offset weight, the drive belt mechanism comprising a driver pulley wheel configured to be coupled to the drive shaft, a driven pulley wheel configured to be coupled to the first counterbalance shaft, and a drive belt configured to extend between to transfer rotation from the drive shaft to the first counterbalance shaft, the gear train comprising a first gear configured to be coupled to the first counterbalance shaft and a second gear configured to be coupled to the second counterbalance shaft.

The vibration dampener system 20 includes a first counterbalance shaft 22 with a first offset weight 24 and a second counterbalance shaft 26 with a second offset weight 28 as shown in FIGS. 2-4. The first counterbalance shaft 22 is configured to rotate about a first axis 22A in a first direction. The first offset weight 24 is coupled to the first counterbalance shaft 22 for rotation therewith. The second counterbalance shaft 26 is configured to rotate about a second axis 26A in a second direction opposite the first direction of the first counterbalance shaft 22. The second offset weight 28 is coupled to the second counterbalance shaft 26 for rotation therewith so that the second offset weight 28 opposes the first offset weight 24 at neutral positions as the needle bar 14 linearly reciprocates relative to the sewing machine frame 12.

Each offset weight 24, 28 has a higher mass end 24A, 28A and a lower mass end 24B, 28B as shown in FIGS. 5-8A. The first counterbalance shaft 22 is coupled to the first offset weight 24 closer to the lower mass end 24B of the first offset weight 24 and the second counterbalance shaft 26 is coupled to the second offset weight 28 closer to the lower mass end 28B of the second offset weight 28 as shown in FIGS. 5-8A.

Figure 5A:
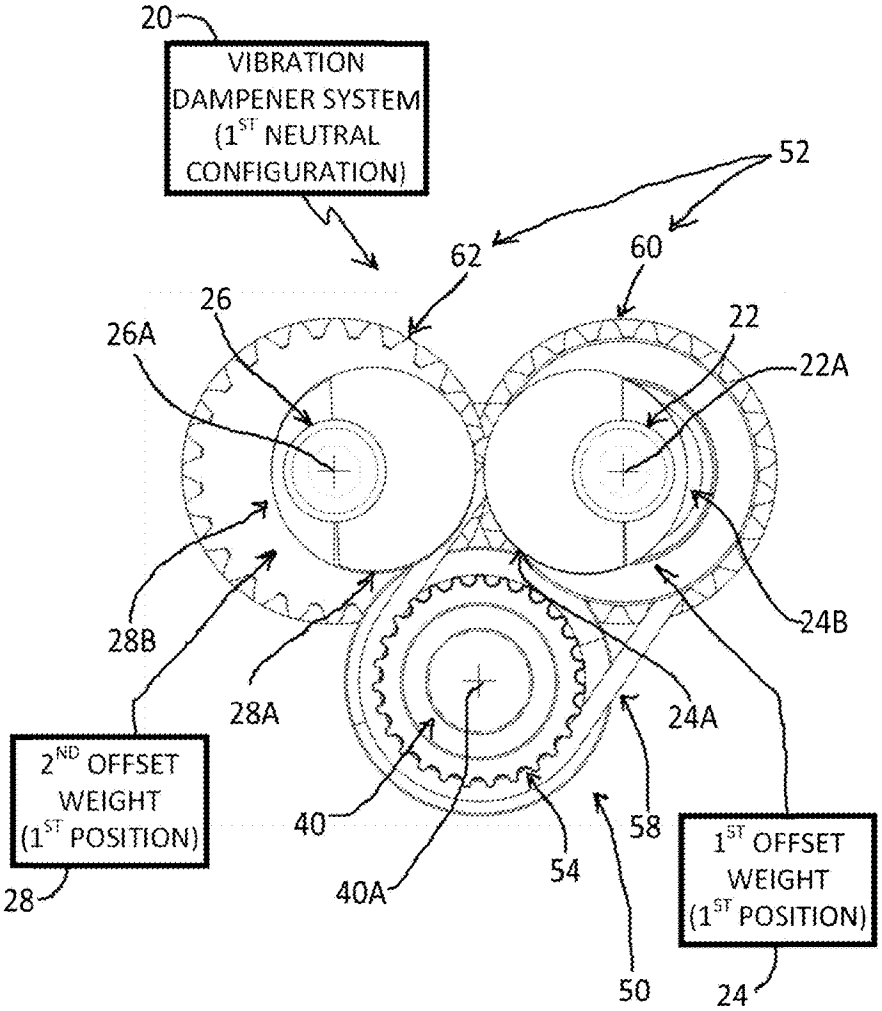
FIG. 5A is a cross-section view of FIG. 5 taken along line A-A showing the offset weights are in the first position, or one of the neutral positions, such that a higher mass ends of each offset weight faces towards each other.
Figure 5:
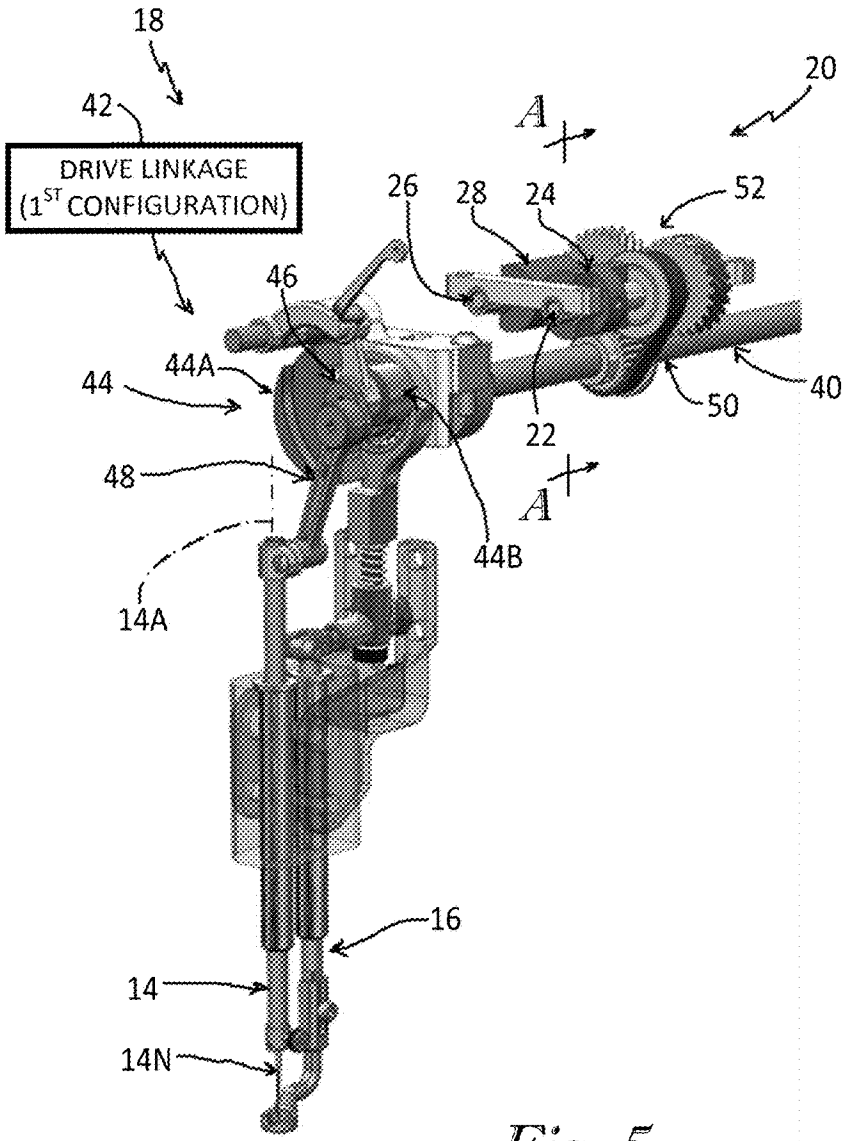
FIG. 5 is a perspective view of the drive system and the vibration dampener system included in the sewing machine assembly of FIG. 2 showing the drive linkage is in a first configuration so that the vibration dampener system is in a first neutral configuration in which the offset weights are in a first position as shown in FIG. 5A.
Figure 6A:
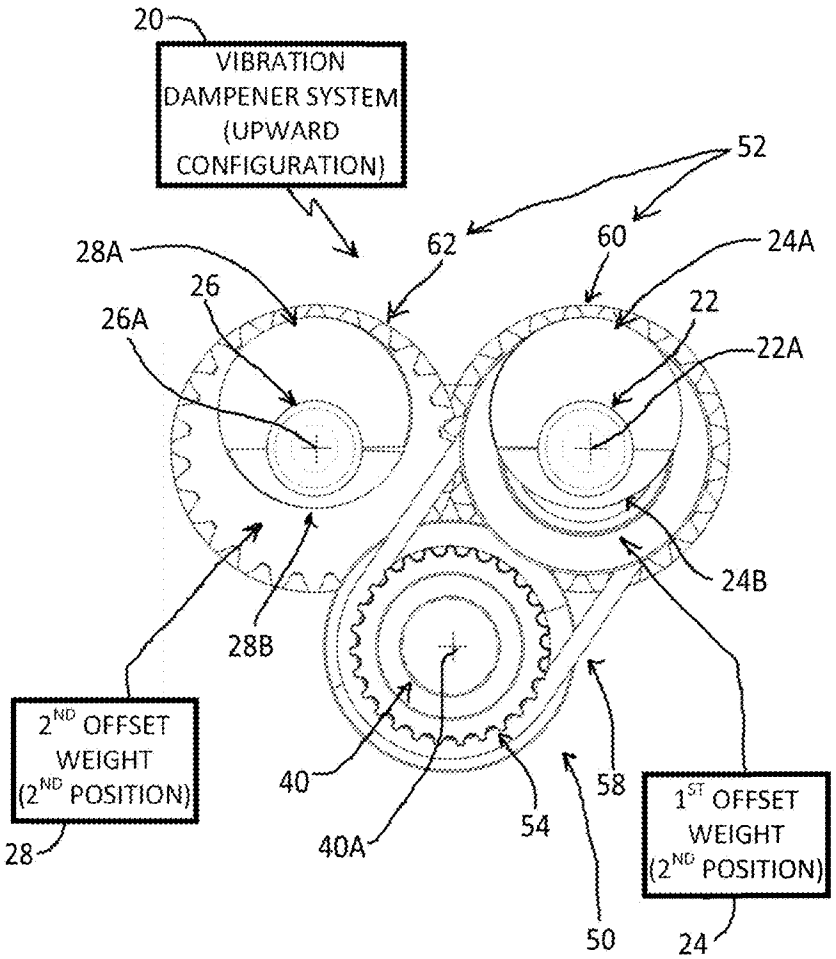
FIG. 6A is a cross-section view of FIG. 6 taken along line A-A showing the offset weights are in the second position such that the higher mass ends of each offset weight are above the respective counterbalance shaft and face away from the drive shaft.
Figure 6:
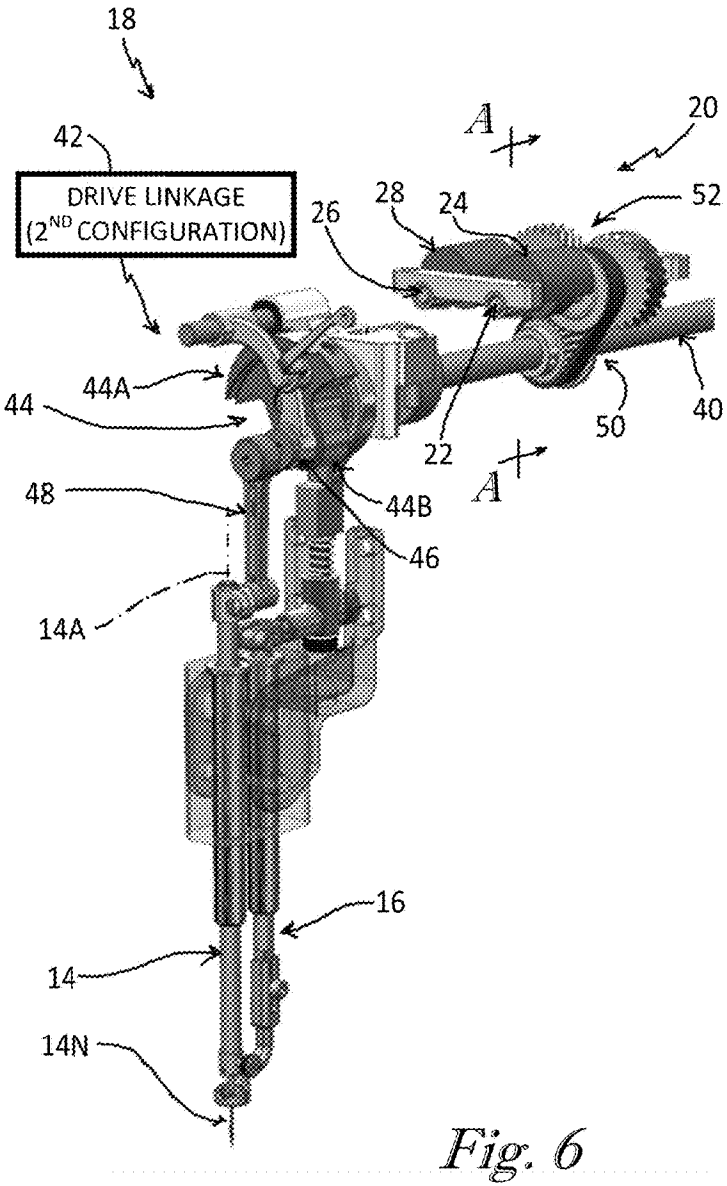
FIG. 6 is a perspective view similar to FIG. 5 showing the drive linkage has moved to a second configuration to cause the needle bar to move downwards into the fabric, and further showing the vibration dampener system has moved to an upward configuration in which the offset weights have rotated in opposite directions to a second position as shown in FIG. 6A.
Figure 7A:
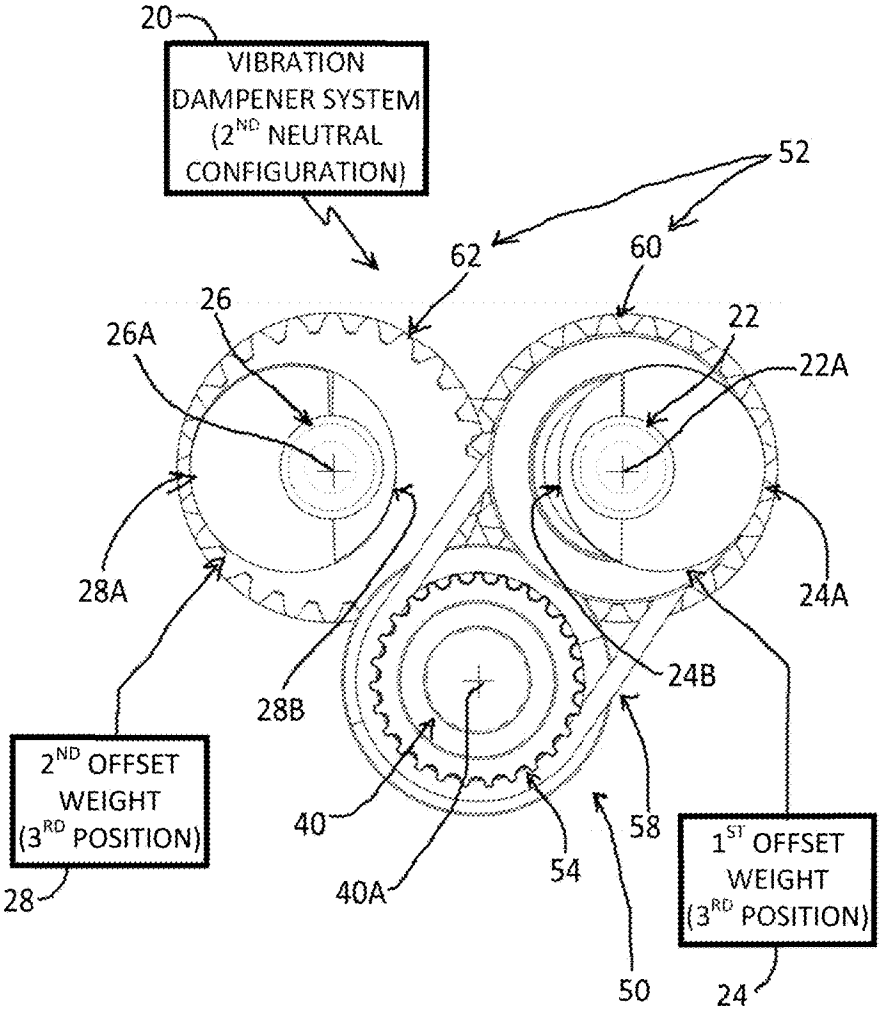
FIG. 7A is a cross-section view of FIG. 7 taken along line A-A showing the offset weights are in the third position, or the other neutral position, such that the higher mass ends of each offset weight face in opposite directions away from each other.
Figure 7:
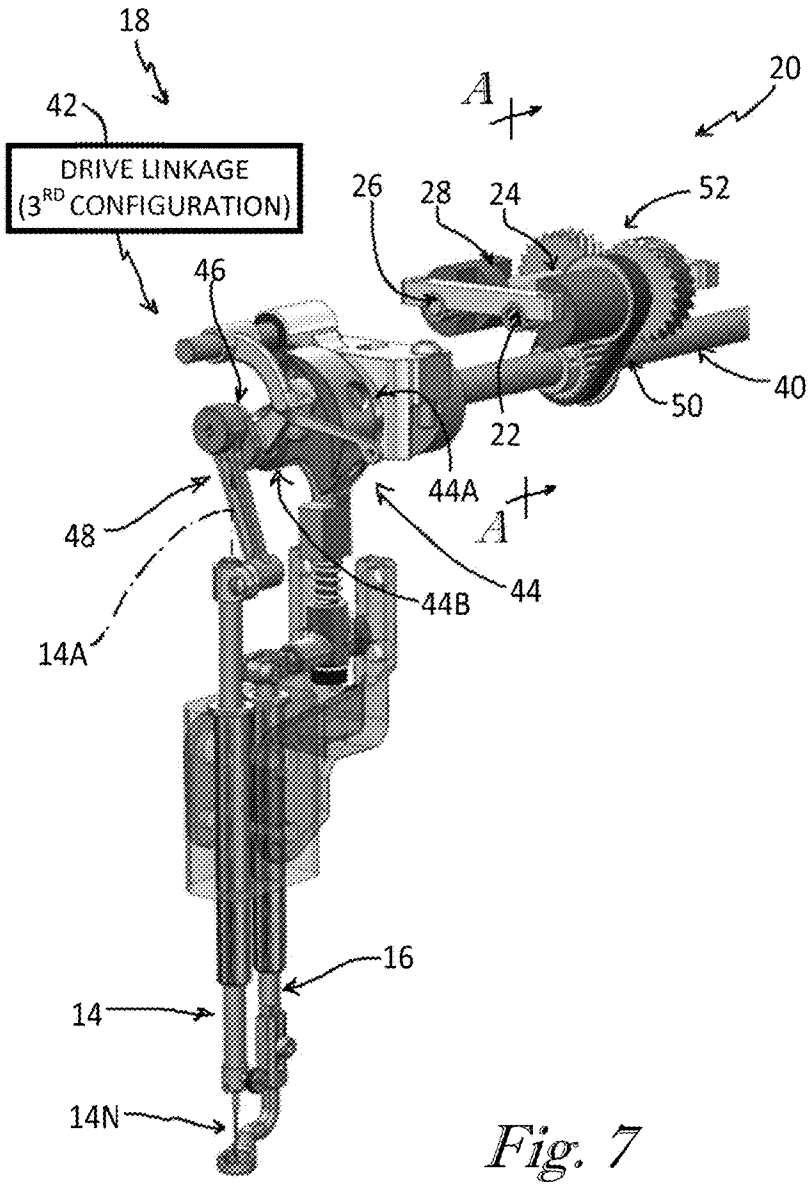
FIG. 7 is a perspective view similar to FIG. 6 showing the drive linkage has moved to a third configuration to cause the needle bar to move back upwards out of the fabric, and further showing the vibration dampener system has moved to a second neutral configuration in which the offset weights have rotated in opposite directions to a third position as shown in FIG. 7A.
Figure 8A:
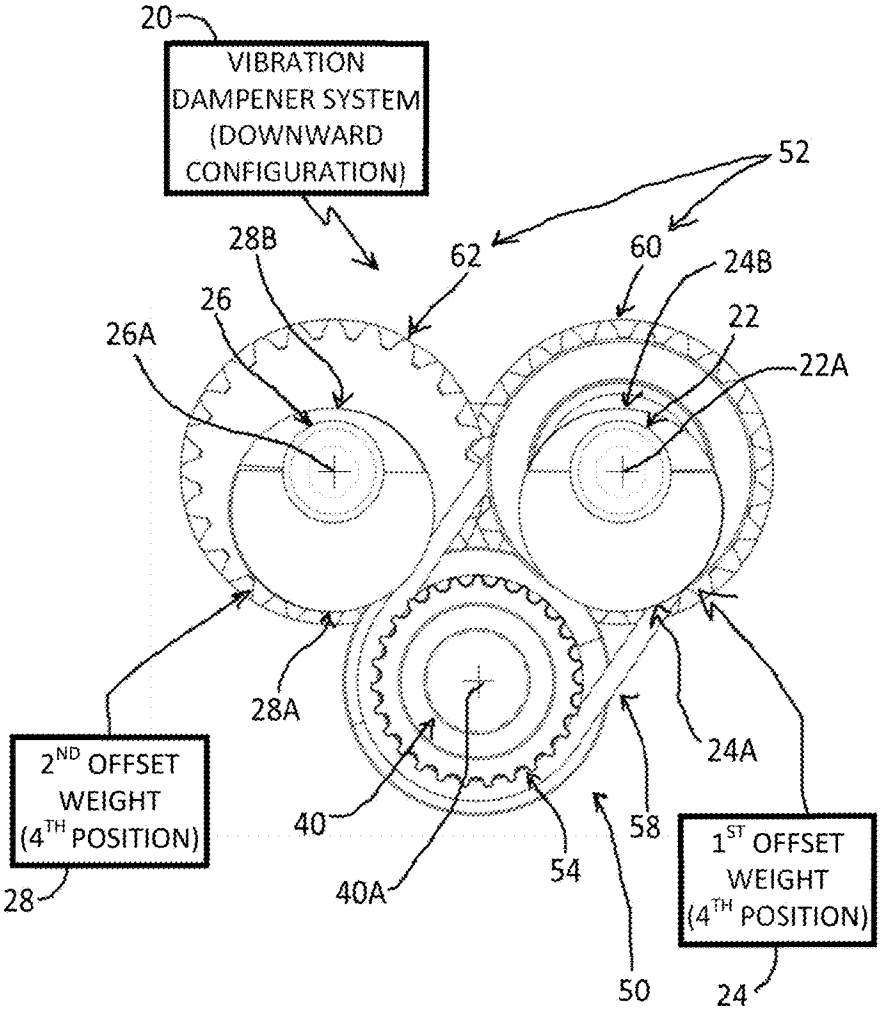
FIG. 8A is a cross-section view of FIG. 8 taken along line A-A showing the offset weights are in the fourth position such that the higher mass ends of each offset weight are below the respective counterbalance shaft and face toward the drive shaft.
Figure 8:
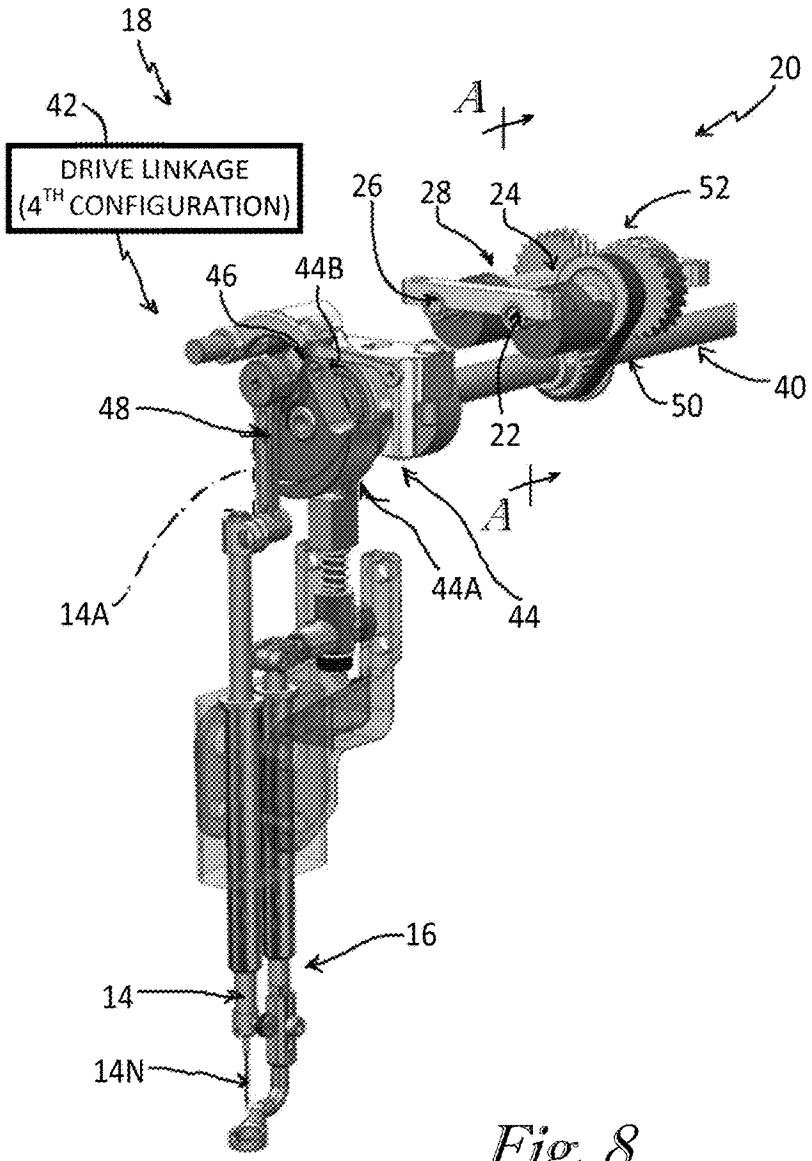
FIG. 8 is a perspective view similar to FIG. 7 showing the drive linkage has moved to a fourth configuration to cause the needle bar to move further upwards away from the fabric, and further showing the vibration dampener system has moved to a downward configuration in which the offset weights have rotated in opposite directions to a fourth position as shown in FIG. 8A.

The vibration dampener system 20 moves through a plurality of positions as the drive system 18 moves the needle bar 14 linearly along the needle bar axis 14A as shown in FIGS. 5-8A. When the needle bar 14 is just above the fabric, but before the needle bar 14 is driven downwardly through the fabric, the vibration dampener system 20 is in a first neutral configuration in which the offset weights 24, 28 are in a first position as shown in FIGS. 5 and 5A. In the first position, or one of the neutral positions, the higher mass ends 24A, 28A of each offset weight 24, 28 faces towards each other as shown in FIGS. 5 and 5A. The first and second offset weights 24, 28 oppose each other in the first position as the needle bar 14 is in between being fully upward as shown in FIG. 6 or fully downward as shown in FIG. 8.

As the needle bar 14 is driven downwardly through the fabric, the vibration dampener system 20 moves to an upward configuration in which the offset weights 24, 28 are in a second position as shown in FIGS. 6 and 6A. In the second position, the higher mass ends 24A, 28A of each offset weight 24, 28 are above the respective counterbalance shaft 22, 26 and face away from the drive shaft 40 as shown in FIGS. 6 and 6A. In the second position, the first and second offset weights 24, 28 provide a balancing force in the upwards direction as the needle bar 14 moves downward.

As the needle bar 14 moves back out of the fabric, the vibration dampener system 20 moves to a second neutral configuration in which the offset weights 24, 28 are in a third position as shown in FIGS. 7 and 7A. In the third position, the higher mass ends 24A, 28A of each offset weight 24, 28 face in opposite directions away from each other as shown in FIGS. 7 and 7A. The first and second offset weights 24, 28 oppose each other in the third position as the needle bar 14 is between being fully upward as shown in FIG. 6 or fully downward as shown in FIG. 8.

As the needle bar 14 moves to the fully upward position, the vibration dampener system 20 moves to the downward configuration in which the offset weights 24, 28 are in a fourth position as shown in FIGS. 8 and 8A. In the fourth position, the higher mass ends 24A, 28A of each offset weight 24, 28 are below the respective counterbalance shaft 22, 26 and face toward the drive shaft 40 as shown in FIGS. 8 and 8A. In the fourth position, the first and second offset weights 24, 28 provide a balance force in the downwards direction as the needle bar 14 moves upward.

Each counterbalance shaft 22, 26 is mounted to the sewing machine frame 12 using mount brackets 30, 32. The sewing machine assembly 10 includes a first mount bracket 30 that mounts one end of each counterbalance shaft 22, 26 and a second mount bracket 32 spaced apart axially from the first mount bracket 30 that mounts the opposite end of each counterbalance shaft 22, 26. Each mount bracket 30, 32 has bearings 34, 36 that support each shaft 22, 26 for rotation about the respective axes 22A, 26A. The mount bracket 30 has bearings 34, while mount bracket 32 has bearings 36 as shown in FIG. 4, Turning again to the drive system 18 includes a drive shaft 40 and a drive linkage 42 as shown in FIGS. 2-4. The drive shaft 40 is configured to rotate about a drive axis 40A in the first direction to drive linear reciprocation of the needle bar 14 along the needle bar axis 14. The drive linkage 42 extends between and interconnects the drive shaft 40 and the needle bar 14 to transfer the rotation of the drive shaft 40 to linear movement of the needle bar 14.

The drive linkage 42 includes a counterbalance weight 44, a link arm 46, and a needle bar crank 48 as shown in FIG. 3. The counterbalance weight 44 is coupled to one end of the drive shaft 40 for rotation therewith. The end of the drive shaft 40 is positioned between a higher mass end 44A of the counterbalance weight 44 and a lower mass end 44B of the counterbalance weight 44. The link arm 46 is coupled to the lower mass end 44B of the counterbalance weight 44 for rotation therewith. The needle bar crank 48 extends between a first end 48A coupled to the link arm 46 and a second end 48B coupled to the needle bar 14.

The drive linkage 42 is configure to move through a plurality of configurations to move the needle bar 14 linearly along the needle bar axis 14A as shown in FIGS. 5-8A.

When the needle bar 14 is just above the fabric, but before the needle bar 14 is driven downwardly through the fabric, the drive linkage 42 is in a first configuration and the vibration dampener system 20 is in the first neutral configuration as shown in FIGS. 5 and 5A. In the first configuration, the counterbalance weight 44 is on the left of the drive shaft 40 when view axially down the drive axis 40A facing a frame head 68 of the sewing machine frame 12.

In the first position, or one of the neutral positions, the higher mass ends 24A, 28A of each offset weight 24, 28 of the vibration dampener system 20 faces towards each other as shown in FIGS. 5 and 5A. The first and second offset weights 24, 28 oppose each other in the first position as the needle bar 14 is in between being fully upward as shown in FIG. 6 or fully downward as shown in FIG. 8.

As the needle bar 14 is driven downwardly through the fabric, the drive linkage 42 moves to a second configuration and the vibration dampener system 20 is in the upward configuration as shown in FIGS. 6 and 6A. In the second configuration, the higher mass end 44A of the counterbalance weight 44 is substantially above the drive shaft 40 when view axially down the drive axis 40A facing the frame head 68 of the sewing machine frame 12.

In the second position, the higher mass ends 24A, 28A of each offset weight 24, 28 of the vibration dampener system 20 are above the respective counterbalance shaft 22, 26 and face away from the drive shaft 40 as shown in FIGS. 6 and 6A. In the second position, the first and second offset weights 24, 28 provide a balancing force in the upwards direction as the needle bar 14 moves downward.

As the needle bar 14 moves back out of the fabric, the drive linkage 42 moves to a third configuration and the vibration dampener system 20 is in the second neutral configuration as shown in FIGS. 7 and 7A. In the third configuration, the counterbalance weight 44 is on the right of the drive shaft 40 when view axially down the drive axis 40A facing a frame head 68 of the sewing machine frame 12.

In the third position, the higher mass ends 24A, 28A of each offset weight 24, 28 of the vibration dampener system 20 face in opposite directions away from each other as shown in FIGS. 7 and 7A. The first and second offset weights 24, 28 oppose each other in the third position as the needle bar 14 is between being fully upward as shown in FIG. 6 or fully downward as shown in FIG. 8.

As the needle bar 14 moves to the fully upward position, the drive linkage 42 moves to a fourth configuration and the vibration dampener system 20 is in the downward configuration as shown in FIGS. 8 and 8A. In the fourth configuration, the higher mass end 44A of the counterbalance weight 44 is substantially below the drive shaft 40 when view axially down the drive axis 40A facing the frame head 68 of the sewing machine frame 12.

In the fourth position, the higher mass ends 24A, 28A of each offset weight 24, 28 of the vibration dampener system 20 are below the respective counterbalance shaft 22, 26 and face toward the drive shaft 40 as shown in FIGS. 8 and 8A. In the fourth position, the first and second offset weights 24, 28 provide a balance force in the downwards direction as the needle bar 14 moves upward.

In the illustrative embodiment, the vibration dampener system 20 is coupled to the drive shaft 40 in between the two ends of the drive shaft 40 as shown in FIG. 3. The vibration dampener system 20 includes the first counterbalance shaft 22 with the first offset weight 24 and the second counterbalance shaft 26 with the second offset weight 28 as shown in FIGS. 2-4.

In the illustrative embodiment, the first counterbalance shaft 22 is coupled to the drive shaft 40 of the drive system 18 and the second counterbalance shaft 24 is coupled to the first counterbalance shaft 22. The first counterbalance shaft 22 is coupled to the drive shaft 40 so that rotation of the drive shaft 40 in the first direction rotates the first counterbalance shaft 22 about the first axis 22A. The second counterbalance shaft 24 is coupled to the first counterbalance shaft 22 so that rotation of the first counterbalance shaft 22 in the first direction drives rotation of the second counterbalance shaft 26 in the second direction about the second axis 26A.

In the illustrative embodiment, the vibration dampener system 20 includes a drive belt mechanism 50 and a gear train 52 as shown in FIG. 3. The drive belt mechanism 50 couples the first counterbalance shaft 22 to the drive shaft 40 so that rotation of the drive shaft 40 rotates the first counterbalance shaft 22. The gear train 52 mates the first counterbalance shaft 22 and the second counterbalance shaft 26 so that rotation of the first counterbalance shaft 22 drives rotation of the second counterbalance shaft 26.

The drive belt mechanism 50 includes a driver pulley wheel 54, a driven pulley wheel 56, and a drive belt 58 as shown in FIGS. 3 and 4. The driver pulley wheel 54 is coupled to the drive shaft 40, while the driven pulley wheel 56 is coupled to the first counterbalance shaft 22. Both pulley wheels 54, 56 have teeth that mate with teeth on the drive belt 58. The drive belt 58 extends between the driver pulley wheel 54 on the drive shaft 40 and the driven pulley wheel 56 on the first counterbalance shaft 22. The drive belt 58 transfers rotation of the drive shaft 40 about the drive axis 40A to the first counterbalance shaft 22 so that the first counterbalance shaft 22 rotates about the first axis 22A in the first direction. In the illustrative embodiment, the drive belt 58 is a timing or toothed belt 58 formed with teeth that mate with teeth on the driver pulley wheel 54 and the driven pulley wheel 56 as shown in FIGS. 3-7A. In some embodiments, the drive belt 58 may be another suitable drive belt type.

The gear train 52 includes a first gear 60 and a second gear 62 as shown in FIGS. 3 and 4. The first gear 60 is coupled to the first counterbalance shaft 22 for rotation therewith. The second gear 62 is coupled to the second counterbalance shaft 26 for rotation therewith. The second gear 62 has teeth that mate with teeth on the first gear 60 so that rotation of the first counterbalance shaft 22 about the first axis 22A in the first direction drives rotation of the second counterbalance shaft 26 about the second axis 26A in the second direction opposite the first direction. The first and second gears 60, 62 may be any suitable gear type, including, but not limited to, helical gears, spur gears, etc. In the illustrative embodiment, the first and second gears 60, 62 are helical gears.

In some embodiments, the second counterbalance shaft 24 may be coupled to the drive shaft 40 of the drive system 18 and the first counterbalance shaft 22 may be coupled to the second counterbalance shaft 24. The drive belt mechanism 50 may be coupled to the second counterbalance shaft 24 so that rotation of the drive shaft 40 drives rotation of the second counterbalance shaft 24. The gear train 52 transfers rotation of the second counterbalance shaft 24 to the first counterbalance shaft 22 so that the first counterbalance shaft 22 rotates in the opposite direction.

In some embodiments, multiple gear trains are used to link the respective shafts together to transfer rotation therebetween. In some embodiments, another linking method may be used to link the rotation of the respective shafts together. In some embodiments, each counterbalance shaft 22, 24 may be independently driven by a separate actuator.

In the illustrative embodiment, the sewing machine frame 12 has a frame base 64, a frame body 66, and a frame head 68 as shown in FIG. 1. The frame body 66 extends from the frame base 64. The frame head 68 is coupled to the frame body 66. The frame head 68 extends from the frame body 66 toward the frame base 64 to define a throat of the sewing machine frame 12.

The drive linkage 42 is located in the frame head 68 of the sewing machine frame 12 as suggested in FIG. 2. The drive shaft 40 is located in the frame body 66 and frame base 64 as suggested in FIG. 2. The vibration dampener system 20 is located in the frame body 66 adjacent to the frame head 68.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A sewing machine assembly comprising:

a sewing machine frame including a frame base, a frame body that extends from the frame base, a frame head coupled to the frame body that extends from the frame body toward the frame base to define a throat of the sewing machine frame;

a needle bar configured to linearly reciprocate relative to the sewing machine frame along a needle bar axis; and a drive shaft coupled to the needle bar and configured to rotate about a drive axis in a first direction to drive linear reciprocation of the needle bar along the needle bar axis; and a vibration dampener system coupled to the drive shaft to reduce vibration of the sewing machine assembly caused by linear reciprocation of the needle bar during use of the sewing machine assembly, wherein the vibration dampener system comprises:

a first counterbalance shaft configured to rotate about a first axis in the first direction;

a first offset weight coupled to the first counterbalance shaft for rotation therewith;

a second counterbalance shaft configured to rotate about a second axis in a second direction opposite the first direction of the first counterbalance shaft; and a second offset weight coupled to the second counterbalance shaft for rotation therewith so that the second offset weight opposes the first offset weight at neutral positions as the needle bar linearly reciprocates relative to the sewing machine frame, wherein the first counterbalance shaft is coupled to the drive shaft so that rotation of the drive shaft about the drive axis in the first direction drives rotation of the first counterbalance shaft about the first axis in the first direction and the second counterbalance shaft is coupled to the first counterbalance shaft so that rotation of the first counterbalance shaft about the first axis in the first direction drives rotation of the second counterbalance shaft about the second axis in the second direction opposite the first direction, wherein the vibration dampener system further comprises:

a first gear coupled to the first counterbalance shaft for rotation therewith; and a second gear coupled to the second counterbalance shaft for rotation therewith; and wherein the second gear mates with the first gear so that rotation of the first counterbalance shaft about the first axis in the first direction drives rotation of the second counterbalance shaft about the second axis in the second direction opposite the first direction.

2. The sewing machine assembly of claim 1, wherein the first offset weight is equal to the second offset weight.

3. The sewing machine assembly of claim 2, further comprising:

a drive linkage that extends between and interconnects the drive shaft and the needle bar to transfer the rotation of the drive shaft to linear movement of the needle bar, the drive linkage comprising a counterbalance weight coupled to one end of the drive shaft for rotation therewith with the drive shaft positioned between a higher mass end of the counterbalance weight and a lower mass end of the counterbalance weight;

a link arm coupled to the lower mass end of the counterbalance weight for rotation therewith; and a needle bar crank that extends between a first end coupled to the link arm and a second end coupled to the needle bar.

4. The sewing machine assembly of claim 2, further comprising:

a counterbalance weight coupled to one end of the drive shaft for rotation therewith with the drive shaft positioned between a higher mass end of the counterbalance weight and a lower mass end of the counterbalance weight.

5. The sewing machine assembly of claim 1, wherein the vibration dampener system further comprises:

a drive belt that extends between the drive shaft and the first counterbalance shaft so that rotation of the drive shaft about the drive axis in the first direction drives rotation of the first counterbalance shaft about the first axis in the first direction.

6. The sewing machine assembly of claim 1, further comprising:

a drive linkage that extends between and interconnects the drive shaft and the needle bar to transfer the rotation of the drive shaft to linear movement of the needle bar, the drive linkage comprising a counterbalance weight coupled to one end of the drive shaft for rotation therewith with the drive shaft positioned between a higher mass end of the counterbalance weight and a lower mass end of the counterbalance weight;

a link arm coupled to the lower mass end of the counterbalance weight for rotation therewith; and a needle bar crank that extends between a first end coupled to the link arm and a second end coupled to the needle bar.

7. The sewing machine assembly of claim 1, further comprising:

a counterbalance weight coupled to one end of the drive shaft for rotation therewith with the drive shaft positioned between a higher mass end of the counterbalance weight and a lower mass end of the counterbalance weight.

8. The sewing machine assembly of claim 1, wherein the first and second gears are helical gears.

9. The sewing machine assembly of claim 1, wherein the first and second gears are spur gears.

10. A vibration dampener system adapted for use with a sewing machine to reduce vibration of the sewing machine caused by reciprocal linear movement of a needle bar during use of the sewing machine, the vibration dampener system comprising:

a first counterbalance shaft coupled to a drive shaft of the sewing machine and configured to rotate about a first axis in a first direction, wherein the drive shaft is coupled to the needle bar and is configured to rotate about a drive axis in the first direction to drive linear reciprocation of the needle bar, a first offset weight coupled to the first counterbalance shaft for rotation therewith; and a second counterbalance shaft coupled to the first counterbalance shaft and configured to rotate about a second axis in a second direction opposite the first direction of the first counterbalance shaft;

a second offset weight coupled to the second counterbalance shaft for rotation therewith so that the second offset weight opposes the first offset weight at neutral positions as the needle bar linearly reciprocates;

a first gear coupled to the first counterbalance shaft for rotation therewith; and a second gear coupled to the second counterbalance shaft for rotation therewith;

wherein the second gear mates with the first gear so that rotation of the first counterbalance shaft about the first axis in the first direction drives rotation of the second counterbalance shaft about the second axis in the second direction opposite the first direction.

11. The vibration dampener system of claim 10, wherein the vibration dampener system further comprises:

a drive belt that extends between the drive shaft and the first counterbalance shaft so that rotation of the drive shaft about the drive axis in the first direction drives rotation of the first counterbalance shaft about the first axis in the first direction.

12. The vibration dampener system of claim 10, wherein the first and second gears are helical gears.

13. The vibration dampener system of claim 10, wherein the first and second gears are spur gears.

14. A vibration dampener system adapted for use with a sewing machine to reduce vibration of the sewing machine caused by reciprocal linear movement of a needle bar during use of the sewing machine, the vibration dampener system comprising:

a first counterbalance shaft coupled to a drive shaft of the sewing machine and configured to rotate about a first axis in a first direction, wherein the drive shaft is coupled to the needle bar and is configured to rotate about a drive axis in the first direction to drive linear reciprocation of the needle bar, a first offset weight coupled to the first counterbalance shaft for rotation therewith; and a second counterbalance shaft coupled to the first counterbalance shaft and configured to rotate about a second axis in a second direction opposite the first direction of the first counterbalance shaft; and a second offset weight coupled to the second counterbalance shaft for rotation therewith so that the second offset weight opposes the first offset weight at neutral positions as the needle bar linearly reciprocates, wherein the first offset weight is equal to the second offset weight, wherein the vibration dampener system further comprises:

a first gear coupled to the first counterbalance shaft for rotation therewith; and a second gear coupled to the second counterbalance shaft for rotation therewith; and wherein the second gear mates with the first gear so that rotation of the first counterbalance shaft about the first axis in the first direction drives rotation of the second counterbalance shaft about the second axis in the second direction opposite the first direction.

15. The vibration dampener system of any one of claim 14, wherein the vibration dampener system further comprises:

a drive belt that extends between the drive shaft and the first counterbalance shaft so that rotation of the drive shaft about the drive axis in the first direction drives rotation of the first counterbalance shaft about the first axis in the first direction.

16. The vibration dampener system of claim 14, wherein the first and second gears are helical gears.

17. The vibration dampener system of claim 14, wherein the first and second gears are spur gears.

* * * * *